United States Patent [19]

Halter et al.

[11] Patent Number: 4,798,351

[45] Date of Patent: Jan. 17, 1989

[54] APPARATUS FOR COILING A FOIL WEB, ESPECIALLY A SYNTHETIC RESIN FOIL WEB

[75] Inventors: Hartmut Halter, Troisdorf-Eschmar; Paul H. Zimmermann, Lohmar; Norbert Achterwinter, Hilden, all of Fed. Rep. of Germany

[73] Assignee: Reifenhauser GmbH & Co. Maschinenfabrik, Troisdorf, Fed. Rep. of Germany

[21] Appl. No.: 94,229

[22] Filed: Sep. 8, 1987

[30] Foreign Application Priority Data

Sep. 9, 1986 [DE] Fed. Rep. of Germany ..... 3630572

[51] Int. Cl.[4] ..... B65H 19/28; B65H 19/26

[52] U.S. Cl. ..... 242/65; 242/56 A; 242/56 R

[58] Field of Search ..... 242/65, 56 A, 195; 292/78.1, 78.3, 56 R

[56] References Cited

U.S. PATENT DOCUMENTS

| | | | |
|---|---|---|---|
| 2,676,764 | 4/1954 | Aulen | 242/56 R |
| 3,328,989 | 7/1967 | Stephan | 242/78.1 |
| 3,883,084 | 5/1975 | Yamaguchi et al. | 242/56 R |
| 4,339,092 | 7/1982 | Benoy et al. | 242/56 R |

FOREIGN PATENT DOCUMENTS 2345823 8/1976 Fed. Rep. of Germany .

*Primary Examiner*—Stuart S. Levy
*Assistant Examiner*—Steven M. Dubois
*Attorney, Agent, or Firm*—Herbert Dubno

[57] ABSTRACT

The apparatus for winding a foil sheet, especially a plastic foil sheet, on a roll core is used in a step in the winding of a foil sheet into a foil sheet roll with a foil sheet winding machine. The apparatus comprises a contacting roll, a roll core receptacle and a cross cutter. A roll core put in the roll core receptacle is placed on the contacting roll and is drivable by it with the intervening foil sheet running to the downstream foil sheet roll. The foil sheet is cuttable with the help of the cross cutter between the roll core and the downstream foil sheet roll. Further the leading end piece of the next following foil sheet formed by cutting is receivable by the roll core. Above the roll core received in the roll core receptacle a foil sheet press device is mounted which is placeable on the roll core by a pivot motion and has a press element travelling with it during pivoting. The press element, advantageously a press belt, embraces the roll core on the side of the roll core facing away from contacting roll and forms an engaging wedge space with the roll core. An air blower tube is located between the engaging wedge space and the cross cutter under the next uncut foil sheet. The blower air streams from this blower tube are directed in the engaging wedge space and/or substantially parallel to the engaging direction of the engaging wedge space to assist in engaging the next following foil sheet on the roll core.

3 Claims, 2 Drawing Sheets

APPARATUS FOR COILING A FOIL WEB, ESPECIALLY A SYNTHETIC RESIN FOIL WEB

FIELD OF THE INVENTION

Our invention relates to an apparatus for coiling a foil web, especially a synthetic resin foil web.

BACKGROUND OF THE INVENTION

A foil web, especially a synthetic resin foil web, can be wound up or coiled on a roll core in a foil web winding machine comprising a contacting roll, a roll core receiver and a cross cutter. The roll core is put in the roll core receiver and can be placed on the contacting roll with the intervening foil web running to a downstream foil web coil.

The foil web can be cut with the aid of a cross cutter between the roll core and the downstream foil web coil.

Further, a leading end formed by cutting the foil web with the cross cutter is received by the roll core. The roll core for example can be a paperboard or cardboard roller.

In a foil web winding machine of the above described type, delivery of the finished foil web coils and input of new roll cores is effected automatically for a continuous winding process of foil web to form foil web coils of a predetermined size (see for example German Printed Patent Application 15 74 426 or U.S. Pat. No. 33,50,027).

In the known foil web winding machine currently being used the leading end of the next following foil web formed by cutting is received by the roll core because it is provided or can be provided with a suitable trace or series of portions of adhesive. The winding of a foil web on the roll core with the aid of an adhesive is objectionable with certain foils.

OBJECTS OF THE INVENTION

It is an object of our invention to provide an improved apparatus for coiling a foil web, especially a synthetic resin foil web, whereby the aforementioned drawbacks are avoided.

It is also an object of our invention to provide an improved apparatus for coiling a foil web, especially a synthetic resin foil web, in which winding with glue or adhesive is avoided.

SUMMARY OF THE INVENTION

These objects and others which will become more readily apparent hereinafter are attained in accordance with our invention in an apparatus for winding a foil web, especially a synthetic resin foil web, on a roll core in a step in the coiling of the foil web into a foil web coil with the help of a foil web winding machine comprising a contacting roll, a roll core receiver and a cross cutter. The roll core is put in the roll core receiver and can be placed on the contacting roll with the intervening foil web running to a downstream foil web coil. The foil web can be cut with the help of a cross cuter between the roll core and the downstream foil web coil. Further, a leading end piece formed by cutting the foil web with the cross cutter is received by the roll core.

According to our invention a foil web press device is mounted above the roll core received by the roll core receiver. The foil web press device is engagable on the roll core by a pivot motion and a press element travels along with the press device in the pivot motion. The press element embraces the roll core on the side of the roll core facing away from the contacting roll and forms a wedge-shaped outlet space for the roll core. An air blower tube is positioned between the wedge-shaped outlet space and the cross cutter below the next following uncut foil web. The blower air stream from the air blower tube is directed in the wedge-shaped outlet space and/or substantially parallel to the engaging direction of the wedge-shaped outlet space.

The invention makes use of a press device to make the adhesive-free winding of the synthetic resin foil strip or foil strip on the roll core possible when the press element on the one hand forms a wedge-shaped outlet space and on the other hand has a sufficient contact angle. Then the leading end piece of the next foil web following after cutting is fed with blower air stream in the wedge-shaped outlet space. It adheres surprisingly well to the roll core when it comprises a conventional material to be wound smoothly by the next layer when the press element has a sufficient contact angle, for example between 120° to 180°.

The preceeding requirements are particularly easily fulfilled when the foil web press device has at least one guide roller holder with a press belt guided and provided with tension by a plurality of guide rollers and one of the guide rollers is mounted on a pivotable lever arm of the guide roller holder and on setting the press belt on the roll core the press belt is adjustable to a predetermined contact angle on engagement therewith. Here the guide rollers, the press belt and the lever collectively form a pressing member.

BRIEF DESCRIPTION OF THE DRAWINGS

The above and other objects, features and advantages of our invention will become more readily apparent from the following description, reference being made to the accompanying highly diagrammatic drawing in which.

SPECIFIC DESCRIPTION

Figure 1:
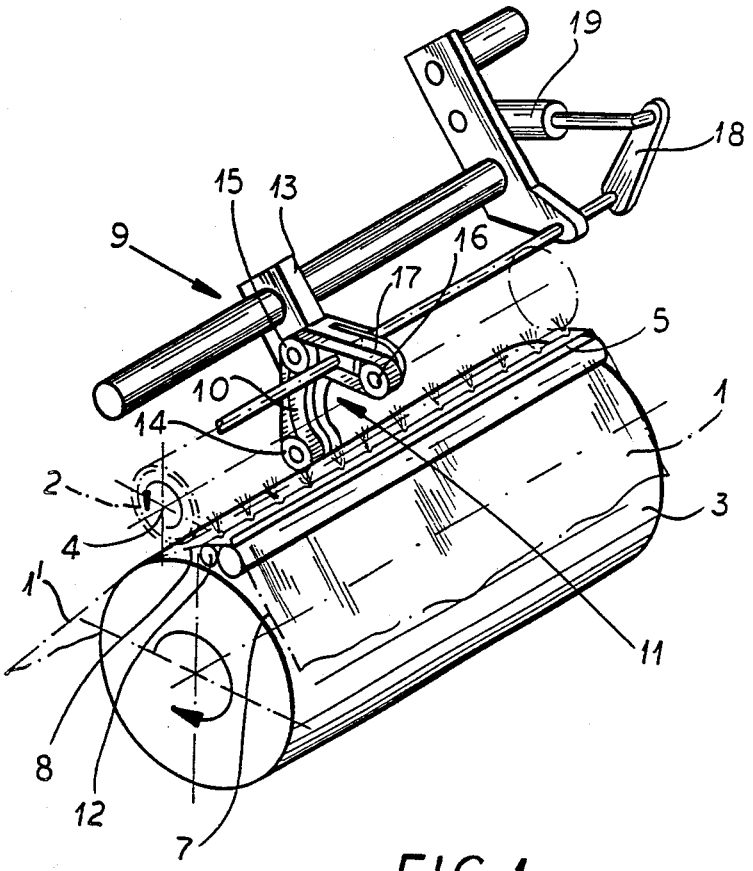
FIG. 1 is a perspective view of a portion of a foil web winding machine having the apparatus for winding according to our invention in the operating position, i.e. in the pivoted in or engaged position.

The apparatus shown in the drawing acts to wind in or roll in a foil web 1, particularly a synthetic resin foil web, on a roll core 2 in a single step in the winding of the foil web 1 to form a wound coil with the help of a foil web winding machine.

The foil web winding machine has a contacting roll 3, a roll core receiver 4 and a cross cutting device 5. The apparatus is designed so that the roll core 2 put in the roll core receiver 4 can be placed on and is drivable by the contacting roll 3 with the intervening foil web 1 running to a downstream foil web coil 6.

The foil web 1 can be cut with the help of the cross cutter 5 between the roll core 2 and the downstream foil web coil 6.

Figure 2:
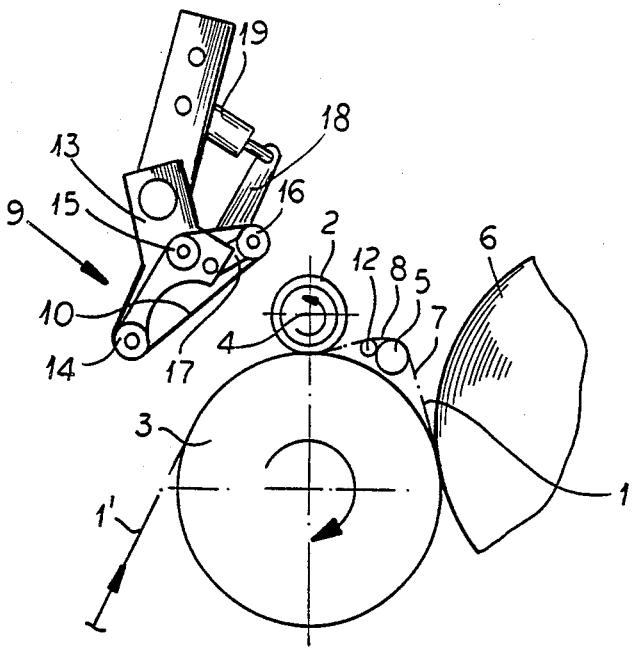
FIG. 2 is a side elevational view of the apparatus shown in FIG. 1 in the pivoted out or disengaged position.

As can be seen from FIG. 2, where the cross cutter 5 is visible, the foil web 1 can be set between the roll core 2 and the contacting roll 3.

By cutting the foil web 1 there arises a trailing end 7 which is completely wound on the foil web coil 6 and a leading end 8 of the following foil web 1' which must be received by the roll core 2 arise.

Furthermore a foil web press device 9 is located above the roll core 2 received in the roll core receiver 4.

The foil web press device 9 can be set on the roll core 2 by a pivot motion. It has press element 10 travelling with it during this motion. The press element 10 embraces the roll core 2 on the side of the roll core 2 facing away from the contacting roll 3. It forms a wedge-shaped outlet shape space 11 for the roll core 2. Furthermore this functional configuration is illustrated in reference to FIG. 1.

From FIGS. 1 and 2 it can be seen that an air blower tube 12 is positioned between the wedge-shaped outlet shape space 11 ad the cross cutter 5 under the foil web 1 in its uncut state. The blower air streams from the air blower tube 12 are directed into the wedge shape space 11 and/or substantially parallel to the engaging direction of the wedge-shaped outlet space 11.

Figure 3:
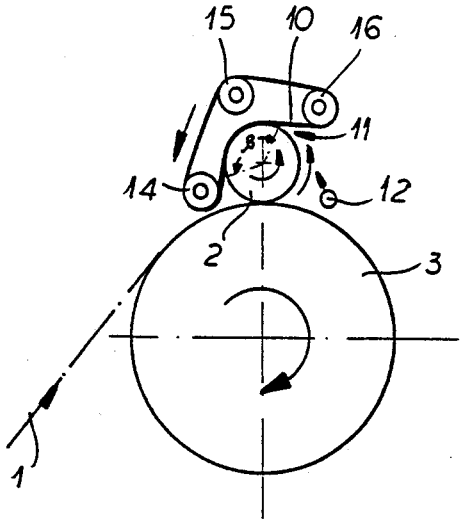
FIG. 3 is a diagram showing the relationship of FIG. 1 from another view.

Thus the leading end piece 8 of the following foil web 1 reaches the wedge-shaped outlet space 11 and is wound by the press device 9 in accordance with the angle of contact or gripping angle on the roll core 2. The angle B, of contact or gripping angle (FIG. 3) is large enough to guarantee that a winding in of this end piece 8 is effected by the next layer of the foil web 1'.

The foil web press device 9 has at least one guide roller holder 13 with three guide rollers 14, 15 and 16 determining a triangle.

The foil web press device 9 has a press belt acting as the press element 10 which is guided over and provided with tension by the guide rollers 14,15 and 16. One of the guide rollers 16 is mounted on a pivotable lever arm 17 of the guide roller holder 13. This is designed so that this guide roller 16 is swingable on engagement of the press belt 10 against the roll core 2 to a predetermined contact angle B, of the press belt. Usually the press belt is under tension in all operating configurations. The described motions of the assembly apparent from FIGS. 1 and 2 are performed in this example by a suitable pivotable lever arm 18 and a positioning cylinder device 19.

We claim:

1. In an apparatus for winding a foil web, especially a synthetic resin foil web, on a roll core as a step in the coiling of said foil web into a foil web coil with the help of a foil web winding machine comprising a contacting roll, a roll core receiver and a cross cutter, said roll core put in said roll core receiver being placeable on said contacting roll with said foil web intervening and running to a downstream one of said foil web coils and said foil web being cuttable with the aid of said cross cutter between said roll core and said downstream foil web coil, and a leading end piece formed by cutting said foil web with said cross cutter being receivable by said roll core, the improvement wherein a foil web press device is mounted above said roll core receivable by said roll core receiver, pivot means for mounting said foil web press device above said roll core, and said foil web press device being engagable on said roll core by a pivot motion and being provided with at least one press element travelling along with said press device in said pivot motion, said press element embracing said roll core on the side of said roll core facing away from said contacting roll and forming a wedge-shaped outlet space for said roll core, said press element having a contact angle of between 120° to 180° with respect to said roll core, and an air blower tube is located between said entrance wedge space and said cross cutter below the next following uncut one of said foil webs, the blower air stream from said air blower tube being directed in said wedge-shaped outlet space substantially parallel to the engaging direction of said wedge-shaped outlet space.

2. The improvement according to claim 1 wherein said foil web press device has at least one guide roller holder with a press belt guided and provided with tension by a plurality of guide rollers and one of said guide rollers is mounted on a pivotable layer arm of said guide roller holder and on setting said press belt on said roll core is adjustable to a predetermined contact angle on contact therewith.

3. An apparatus for winding a foil web, especially a synthetic resin foil web, on a roll core as a step in the coiling of said foil web into a foil web coil with the help of a foil web winding machine comprising:

a contacting foil;

a roll core receiver;

a cross cutter for said foil web, said roll core being positioned in said roll core receiver being placeable on said contacting roll with said foil web intervening and running to a downstream one of said foil web coils and said foil web being cuttable with the aid of said cross cutter between said roll core and said downstream foil web coil, and a leading end piece formed by cutting said foil web with said cross cutter being receivable by said roll core;

pivot means for mounting said foil web press device above said roll core, and;

a foil web press device mounted above said foil core received by said roll core receiver, said foil web press device being engagable on said foil core by a pivot motion and having a press belt travelling along with said press device in said pivot motion, said press belt embracing said roll core on the side of said roll core facing away from said contacting roll and forming a wedge-shaped outlet space for said roll core , said press element having a contact angle between 120° and 180° with respect to said roll core, said press belt being held by at least one guide roller holder and provided with tension by a plurality of guide rollers mounted on said guide roller holder and one of said guide rollers being mounted on a pivotable lever arm of said guide roller holder and on setting said press belt on said roll core said press belt is adjustable to a predetermined contact angle; and an air blower tube located between said entrance wedge space and said cross cutter below the next following uncut one of said foil webs, the blower air stream from said air blower tube being directed in said wedge-shaped outlet space substantially parallel to the engaging direction of said wedge-shaped outlet space.

* * * * *